US006141975A

United States Patent [19]

Tatsumi

[11] Patent Number: 6,141,975

[45] Date of Patent: Nov. 7, 2000

[54] SAMPLE COOLER

[75] Inventor: Nobuyuki Tatsumi, Kyoto, Japan

[73] Assignee: Shimadzu Corporation, Kyoto, Japan

[21] Appl. No.: 09/411,627

[22] Filed: Oct. 1, 1999

[30] Foreign Application Priority Data

Oct. 30, 1998 [JP] Japan ..... 10-309733

[51] Int. Cl.[7] ..... F25D 25/00; F25B 21/02

[52] U.S. Cl. ..... 62/62; 62/3.2; 62/3.7

[58] Field of Search ..... 62/62, 3.7, 3.3, 62/3.2; 356/244, 96, 246

[56] References Cited

U.S. PATENT DOCUMENTS 4,066,365 1/1978 Staunton ..... 62/3 X
4,119,403 10/1978 Rex ..... 422/93 X
4,548,259 10/1985 Tezuka et al. ..... 62/3 X
4,865,986 9/1989 Coy et al. ..... 435/290
5,317,883 6/1994 Newman ..... 62/419
5,446,263 8/1995 Eigen et al. ..... 219/521
5,819,842 10/1998 Potter et al. ..... 165/206

*Primary Examiner*—Corrine McDermott
*Assistant Examiner*—Chen-Wen Jiang
*Attorney, Agent, or Firm*—Majestic, Parsons, Siebert & Hsue P.C.

[57] ABSTRACT

A sample cooler includes a cooling device such as a Peltier device and a rack for supporting vessels containing liquid samples. The rack is made of both a heat conducting material which is in a heat-communicating relationship with the side walls of the vessels and a thermally insulating material contacting the bottoms of the vessels such that the cooling device serves to cool the liquid samples through the heat conducting material and through the side walls of the vessels, not through the bottoms.

8 Claims, 2 Drawing Sheets

SAMPLE COOLER

BACKGROUND OF THE INVENTION

This invention relates to sample coolers for cooling liquid samples and keeping them cool before they are subjected to an analysis by an apparatus such as a liquid chromatograph for automatically analyzing a liquid sample.

A liquid chromatograph carries out an automatic analysis by mounting vessels preliminarily sealing in small amounts of samples to a rack, setting this rack to an automatic sample injector, causing the automatic sample injector to sequentially suck up the samples from these vessels mounted to the rack and injecting them into the liquid chromatograph according to a specified program. In most situations, the samples on the rack waiting to be analyzed are left under a room temperature condition but there are also situations that some of the samples must be kept at a lower temperature condition in order to prevent decomposition or deterioration. In such a situation, a sample cooler is employed in order to keep these samples under a cooled condition.

Conventional sample coolers are either of the direct cooling type or of the air cooling type. A sample cooler of the direct cooling type uses a rack made of a metallic material with high thermal conductivity and a cooling device such as a Peltier element is attached to the bottom of the rack such that the temperature of the samples can be controlled mainly by heat conduction through solid materials. With a sample cooler of the air cooling type, essential parts of the automatic sample injector including the rack are enclosed inside a heat insulating housing and the air inside the housing is cooled such that the sample temperature is controlled through the air.

Next, the direct cooling type, to which the present invention relates, will be explained more in detail.

FIG. 4 shows one of conventional sample coolers of the direct cooling type. The user initially places liquid samples 4 inside vessels 2 (usually small glass bottles) and closes each of their openings with a septums 3. (Strictly speaking, numeral 3 indicates both a cap and a septum, but they are herein simply referred to as the "septum".) These vessels 2 are mounted onto a rack 1 taken out of an automatic sample injector 7. The rack 1 is made of aluminum and is provided with about 100 holes 5 for accepting these sample-containing vessels 2. Heat (including cold heat) is transmitted to these vessels 2 through the bottoms, as well as the inner surfaces, of these holes 5.

After the sample-containing vessels 2 are mounted to the rack 1, the rack 1 is set on top of a metallic block 23 inside the injector 7. The metallic block 23 is adapted to be cooled by means of a Peltier element 21, serving as a cooling device, attached to its bottom surface, while its upper surface makes a close contact with the bottom of the rack 1 so as to serve as an efficient heat conductor therebetween. It now goes without saying that the rack 1 itself also serves as an efficient heat conductor to the vessels 2. The Peltier element 21 is controlled by a temperature-adjusting device (not shown) to cool the metallic block 23 to a specified temperature by absorbing heat therefrom through its heat-absorbing surface. Heat radiating fins 22 are attached to the back surface (the heat-radiating surface) of the Peltier element 21 on the side facing the interior of an air duct 27 such that the heat transmitted from the metallic block 23 is radiated out and away through these fins 22 and with the aid of an current caused by a fan 28.

The rack 1, the vessels 2 and the liquid samples 4 therein are thus maintained at a specified low-temperature level. The rack 1 is covered with a heat insulating cover 6 in order to be kept at the desired low-temperature level. The top parts of the vessels 2 surrounding their septums 3, however, are exposed from this cover 6 such that samples can be extracted therethrough by means of a sampling needle 13.

The sampling needle 13 is adapted, according to a program, to move freely not only forward, backward, to the left and to the right but also upward and downward by means of a suitable mechanism (not shown), to draw a liquid sample 4 from a vessel 2 by penetrating its septum 3, to transport the drawn liquid sample 4 to the inlet 12 of the liquid chromatograph and to inject the transported liquid sample 4 into the chromatograph so as to have an analysis carried out. Since each analysis by the liquid chromatograph takes tens of minutes, some of the liquid samples 4 mounted to the rack I may have to wait for tens of hours before they are analyzed. Since the liquid samples 4 are maintained at a desired low-temperature level, however, decomposition and deterioration of the liquid samples can thus be avoided.

Prior art sample coolers of the direct cooling type, as described above, have a high heat conducting efficiency and are capable of lowering the temperature to a desired level within a short period of time. Since the top parts of the vessel 2 are exposed to the air at a room temperature and the rack 1 is cooled from below, as described above, however, a non-uniform temperature distribution is likely to result with the bottom parts of the vessels cooled while their upper parts are warm. Moreover, since the lower parts are cool and hence there is no convection, this non-uniformity of temperature distribution does not disappear with time but continues to remain. If the temperature of a vessel is not uniform, it is likely to cause a non-uniformity in the density of the liquid sample inside. An analysis carried out under such a condition is not trustworthy.

SUMMARY OF THE INVENTION

It is therefore an object of this invention to provide a sample cooler in which such non-uniformity in temperature distribution is not likely to occur.

A sample cooler embodying this invention, with which the above and other objects can be accomplished, may be characterized as comprising a cooling device such as a Peltier device and a rack for supporting the vessels containing liquid samples and wherein the rack comprises a heat conducting material which is in a heat-communicating relationship with the side walls of the vessels and a thermally insulating material contacting the bottoms of the vessels such that the cooling device serves to cool the liquid samples through the heat conducting material and through the side walls of the vessels, not through the bottoms. The heat conducting material of the rack may be in part in the form of a plate with throughholes for holding the vessels inside. The bottoms of the vessels may be made to contact a base plate of a thermally insulating material attached at the bottom of the thermally conductive plate or a disk made of a thermally insulating material may be disposed at the bottom of each hole formed in the thermally conducting plate.

With a sample cooler thus structured, the sample-containing vessels are cooled mainly from the side, not from the bottom. Thus, a convection current will quickly uniformize the temperature distribution inside the vessels.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

Throughout herein, like components which are substantially similar or equivalent to each other are indicated by same numerals even where they are components of different sample coolers, and they may not necessarily be explained repetitiously for the purpose of simplifying the description.

DETAILED DESCRIPTION OF THE INVENTION

Figure 1:
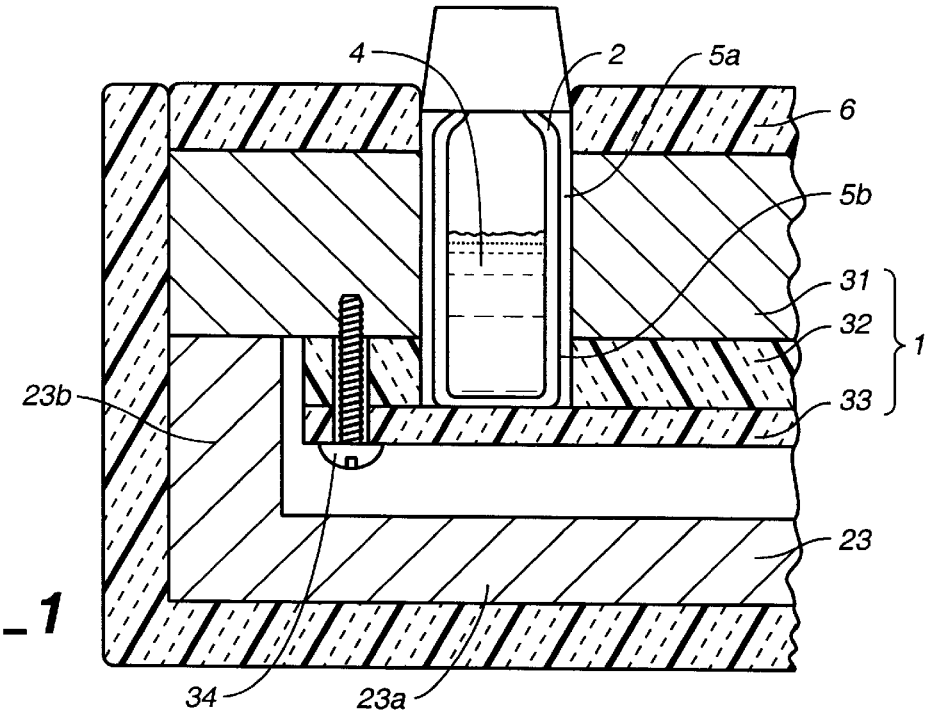
FIG. 1 is a sectional view of a portion of a sample cooler embodying this invention.
Figure 4:
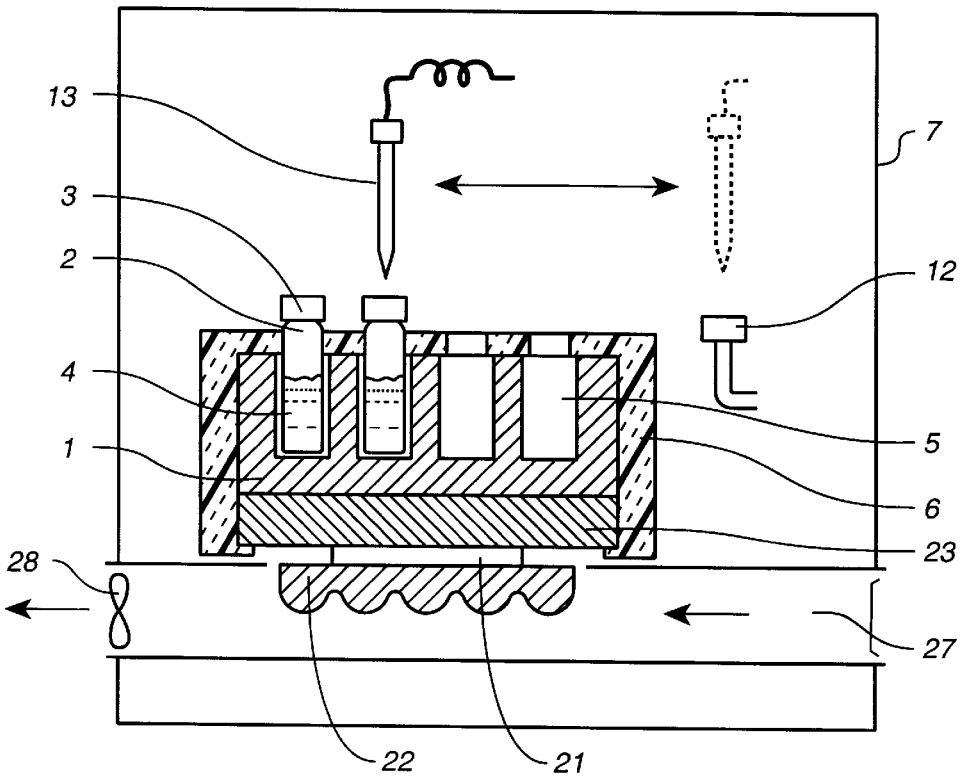
FIG. 4 (PRIOR ART)
FIG. 4 is a schematic sectional view of a prior art sample cooler.

The invention is described next by way of an example with reference to FIG. 1. Since this example is in part structured similarly to the prior art sample cooler shown in FIG. 4, only portions thereof which are different, including a rack and a sample vessel, are shown in FIG. 1. Those components which are substantially similar or equivalent to each other are indicated by the same numerals and will not be repetitiously explained.

As shown in FIG. 1, the rack 1 is mainly structured with a metallic plate 31, a planar spacer 32 and a bottom plate 33. The metallic plate 31 is of a heat-conductive material and is provided with throughholes 5*a* (only one throughhole being shown in FIG. 1) each for placing a sample vessel 2 therein. The spacer 32 and the bottom plate 33, which have approximately the same planar dimensions as the metallic plate 31, are superposed one above the other and are together affixed to the bottom surface of the metallic plate 31 by screws 34 (only one screw being shown in FIG. 1). The spacer 32 is made of a material such as foaming polyethylene with a superior thermal insulation and is also provided, like the metallic plate 31, with throughholes 5*b* for receiving the vessels 2 therein. The bottom plate 33 is made of a hard plastic material and serves to support the sample vessels 2 from below.

Numeral 23 indicates a metallic block with side walls 23*b* standing vertically upward and thermally contacting the metallic plate 31 of the rack 1. The base 23*a* of this metallic block 23 is not different from that of the prior art sample cooler shown in FIG. 4, having a Peltier element (not shown in FIG. 1) attached thereto such that the sample vessels 2 are cooled through the base 23*a* and the side walls 23*b* of the thermally conductive metallic block 23 as well as the metallic plate 31. The lower parts of the side walls and the bottom surface of the sample vessel 2 are not cooled easily because they contact thermally insulating materials such as the spacer 32 and the bottom plate 33. Thus, the liquid samples 4 inside the sample vessels 2 are cooled mainly from above and, since this give rise to convection currents, the occurrence of non-uniformity in the temperature distribution can be effectively prevented.

As a typical example, the total height of the sample cooler may be 32 mm. If the rack 1 is for supporting 100 sample vessels each of capacity 1.5 ml, the thickness of the metallic plate 31, the spacer 32 and the bottom plate 33 may be about 1.5 mm, 5 mm and 3 mm, respectively. A test experiment was carried out by using a sample cooler as shown in FIG. 1 and setting the target temperature at 5° C. when the room temperature was 25° C. With sample vessels each filled with about 0.8 ml of a liquid sample (about one half of the vessels' capacity), the temperature difference of the liquid samples between their surface and the bottom parts was less than 1° C.

As a variation of the sample cooler shown in FIG. 1, the spacer 32 may be dispensed with, leaving its space empty such that the layer of air which occupies this space will serve as a thermal insulator. This variation is advantageous in that the number of constituent parts is reduced and hence the structure as a whole becomes simpler. Moreover, such an empty space can serve conveniently for the discharge of any dew water.

Figure 2:
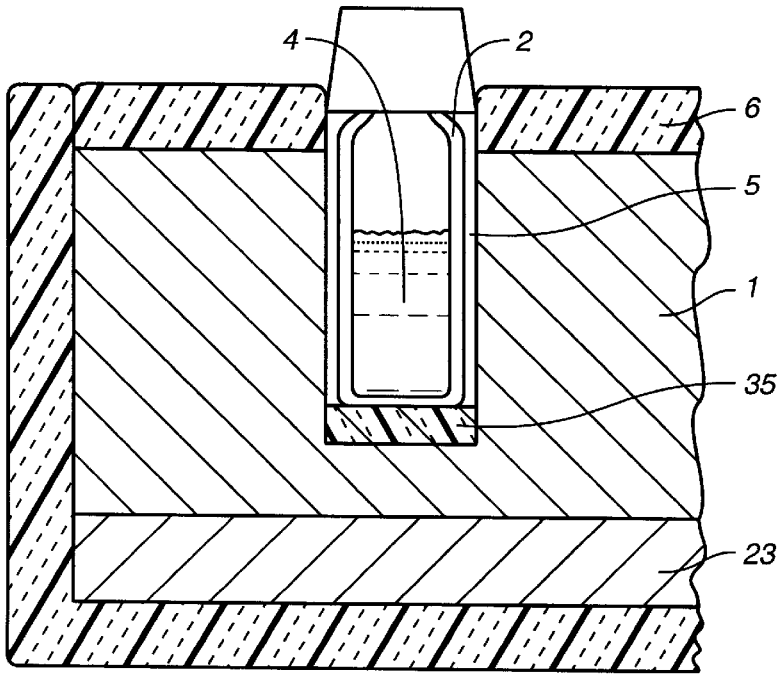
FIG. 2 is a sectional view of a portion of another sample cooler embodying this invention.

FIG. 2 shows a portion of another sample cooler with a simpler structure embodying this invention. Only the portion which is different from the prior art sample cooler described above with reference to FIG. 4 is shown in FIG. 2 and will be described below.

The difference is only in that a circular disk 35 made of a thermally insulating material is disposed at the bottom of each hole 5 formed in the rack 1 for supporting a sample vessel 2 therein. This disk 35 serves to prevent any sudden cooling of the sample vessel 2 from below and to thereby prevent the occurrence of non-uniform temperature distribution inside the sample vessel 2. The material for the disk 35 should be not only thermally insulating but also strongly resistant against chemicals in view of the possibility of a sample leakage. Examples of the material for the disk 35 include foaming polyethylene.

Figure 3:
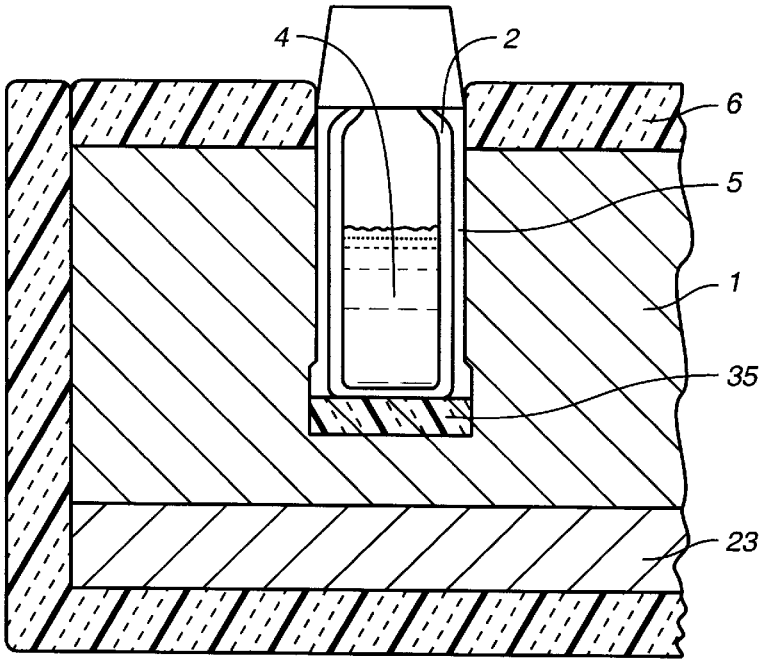
FIG. 3 is a sectional view of a portion of still another sample cooler embodying this invention.

FIG. 3 shows a variation of the sample cooler shown in FIG. 2, being different therefrom only in that the inner diameter of the holes 5 in the rack 1 is made larger near the bottom where the insulating disk 35 is disposed than near the top. The extra space provided inside the hole 5 outside the sample vessel 2 serves to further reduce the rate of transmission of heat from the inner wall of the hole 5 such that the sample vessel 2 is cooled principally from the transmission of (cold) heat from the upper part of the inner wall of the hole 5. As a result, a convection current becomes more likely to result and the probability of the occurrence of a non-uniform temperature distribution is further reduced.

In summary, sample coolers according to this invention are characterized as having a thermally conductive material contacting, or in a heat-communicating relationship with, the side walls of the sample vessels and thermally insulating materials contacting their bottoms such that the sample vessels are cooled mainly through their side walls and there is no strong cooling from below. Thus, non-uniformity in the temperature distribution is not likely to result and hence non-uniformity in density caused by the non-uniform temperature distribution can be prevented. As a result, the repeatability of analysis is substantially improved.

What is claimed is:

1. A sample cooler for cooling liquid samples contained in vessels, said vessels each having a side wall and a bottom, said sample cooler comprising:

a cooling device;

a rack for supporting the vessels, said rack comprising a heat conducting material and a thermally insulating material, said heat conducting material being in a heat-communicating relationship with the side walls of said vessels and including a metallic plate having holes each having a bottom and serving to hold one of said vessels therein, said thermally insulating material contacting the bottoms of said vessels, said cooling device serving to cool said liquid samples through said heat conducting material of said rack; and disks of a thermally insulating material, each of said disks being disposed at the bottom of a corresponding one of said holes.

2. The sample cooler of claim 1 wherein said disks are made of a material which is resistant against chemicals.

3. The sample cooler of claim 2 wherein said holes each have an inner side wall which is in said heat-communicating relationship with the side wall of the vessel held in the hole.

4. The sample cooler of claim 3 wherein each of said holes has a larger inner diameter near said bottom than away from said bottom.

5. The sample cooler of claim 2 wherein each of said holes has a larger inner diameter near said bottom than away from said bottom.

6. The sample cooler of claim 1 wherein said holes each have an inner side wall which is in said heat-communicating relationship with the side wall of the vessel held in the hole.

7. The sample cooler of claim 6 wherein each of said holes has a larger inner diameter near said bottom than away from said bottom.

8. The sample cooler of claim 1 wherein each of said holes has a larger inner diameter near said bottom than away from said bottom.

* * * * *